US006381433B1

(12) United States Patent
Sakai

(10) Patent No.: US 6,381,433 B1
(45) Date of Patent: Apr. 30, 2002

(54) IMAGE FORMING APPARATUS AND ITS PHOTOCONDUCTOR CLEANING METHOD

(75) Inventor: Shinichi Sakai, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/639,162

(22) Filed: Aug. 16, 2000

(30) Foreign Application Priority Data

Aug. 18, 1999 (JP) ..... 11-231954

(51) Int. Cl.[7] ..... G03G 15/10
(52) U.S. Cl. ..... 399/250
(58) Field of Search ..... 399/92, 233, 237, 399/249, 250, 251, 348, 358

(56) References Cited

U.S. PATENT DOCUMENTS 5,884,128 A * 3/1999 Park ..... 399/250
5,905,928 A * 5/1999 Shin ..... 399/250
5,950,054 A * 9/1999 Kim ..... 399/237
5,978,631 A * 11/1999 Lee ..... 399/251
6,085,055 A * 7/2000 Shin et al. ..... 399/250
6,141,518 A * 10/2000 Shin et al. ..... 399/250
6,178,299 B1 * 1/2001 Kim ..... 399/251 X

* cited by examiner

*Primary Examiner*—Sandra Brase
(74) *Attorney, Agent, or Firm*—Young & Thompson

(57) ABSTRACT

An image forming apparatus has an absorption roller 8 for absorbing a solvent from a toner image developed on a photosensitive belt 1, a drying roller 9 for drying and vaporizing the absorbed solvent, a liquefaction device 11 for cooling, liquefying and collecting the dried and vaporized solvent, and further, an air pump 10 for circulating a gas that has not been liquefied by the liquefaction device 11 from the liquefaction device 11 to vicinity of the drying roller 9, and wherein the gas is mixed with a newly dried and vaporized solvent, and the mixed gas is liquefied and collected by the liquefaction device 11.

12 Claims, 1 Drawing Sheet

IMAGE FORMING APPARATUS AND ITS PHOTOCONDUCTOR CLEANING METHOD

BACKGROUND OF THE INVENTION

The present invention relates to an image forming apparatus and its photoconductor cleaning method, and more particularly, to an image forming apparatus and its photoconductor cleaning method, in which ink consisting of toner particles dispersed in a solvent is used, the ink is solidified by removing the solvent in this ink, and a characteristic that the solidified ink is transferred to a material having more affinity for the ink in materials lying therebetween is utilized.

Conventionally, in an electro-photographic image forming apparatus, an electric latent image is formed on a photoconductor by means of a laser and so forth, this latent image is developed using toner, a toner image is transferred on a transfer member such as paper, and thereafter, the transferred image is fixed by means of heating, pressurization and so forth, and a copied material is obtained. Here, in the conventional electro-photographic image forming apparatus, ink in which toner particles are dispersed in a solvent is used, and the ink is solidified by removing the solvent in this ink, and a characteristic that the solidified ink is transferred to a material having more affinity for the ink in materials lying therebetween is utilized.

As means for removing the solvent in the ink, there is means for, after the development, squeezing the solvent contained in the ink by means of a squeezing roller, and thereafter, absorbing and removing the remaining solvent by means of an absorption body of revolution (an absorption roller), which was not squeezed by the squeezing roller. At this time, in order to securing capability of collecting the solvent in the absorption body of revolution, although the solvent absorbed from a surface of the absorption body of revolution is vaporized by means of heat, for protection of environment, the vaporized solvent is cooled, and liquefied and collected, and the solvent that was not liquefied is discharged outside the apparatus through a filter.

However, in the conventional electro-photographic image forming apparatus, activated carbon and so forth are used for the above-described filter, and however, since the filter has a life as consumption goods, it is necessary to periodically exchange it, and in case that a user does not exchange the filter, since the collection capability of the filter is deteriorated, concentration of the solvent becomes higher, and there is a task from an aspect of environment protection.

Also, in the solvent vaporized at the process before it is discharged through the filter, much steam is contained, and in case that activated carbon and so forth are used for the filter, since the steam in addition to the solvent is also absorbed, there is also a task that its life is further shortened.

In order to improve the above tasks, a method of setting a mechanism for removing the steam contained in the vapor before the vaporized solvent is discharged through the filter or a mechanism for removing moisture absorbed in the filter becomes to be required, and however, due to increase of the number of components, there is a large task from an aspect of a cost.

SUMMARY OF THE INVENTION

Therefore, the objective of the present invention is to solve the above-described tasks.

Also, the objective of the present invention is to realize an image processing apparatus at a low cost, in which, after a solvent absorbed by an absorption body of revolution is dried and vaporized, the vapor is rarefied by liquefying and collecting it by means of liquefaction means, and the rarefied vapor is mixed with a solvent newly collected, dried and vaporized by means of the absorption body of revolution, and an air flow is circulated so that the vapor is liquefied and collected by the liquefaction device again, and thereby, the vaporized solvent is not discharged outside the apparatus, and environment protection is taken into account.

Moreover, the other objective of the present invention is to realize an image processing apparatus having high user maintenanceability, in which consumption goods such as a filter for discharging the collected solvent are not required.

In order to accomplish such objectives, the first invention of the present invention is an image forming apparatus, and is characterized in that the apparatus includes a photosensitive belt that is a photoconductor for forming a latent image, a developing roller for developing the latent image on the photosensitive belt by means of ink consisting of toner particles dispersed in a predetermined solvent, an absorption body of revolution for absorbing the solvent in the ink developed on the photosensitive belt, a drying roller having a heater inside thereof for evaporating the solvent by means of heat, which has been absorbed by the absorption body of revolution, an air pump for sucking the solvent vaporized by the drying roller, a liquefaction device for cooling, liquefying and collecting the vaporized solvent in a conduit between the air pump and the absorption body of revolution, and a transfer roller being in contact with said photosensitive belt and having a heater inside thereof, and a fuser roller being in contact with said transfer roller and having a heater inside thereof, both of which are disposed downstream from said absorption body of revolution, and wherein paper is transported between the transfer roller and the fuser roller by transport rollers for transporting the paper, and the ink is transferred on the paper, and vapor from the air pump is discharged in vicinity of the absorption body of revolution.

Also, the second invention is characterized in that, in the first invention, the vapor from the air pump is discharged in vicinity of the drying roller.

Also, the third invention is characterized in that, in the first invention, the vapor from the air pump is discharged in a conduit between the drying roller and the liquefaction device.

Also, the fourth invention that accomplishes the above-described objectives is an image forming apparatus, and is characterized in that the apparatus includes a photosensitive belt that is a photoconductor for forming a latent image, a developing roller for developing the latent image on the above-described photosensitive belt by means of ink consisting of toner particles dispersed in a predetermined solvent, an absorption roller for absorbing the solvent in the ink developed on the above-described photosensitive belt, a drying roller having a heater inside thereof for evaporating the solvent by means of heat, which has been absorbed by the above-described absorption roller, an air pump for sucking the solvent vaporized by the above-described drying roller, and discharging the solvent in vicinity of the above-described absorption roller, and a liquefaction device for cooling, liquefying and collecting the vaporized solvent in a conduit between the above-described air pump and the above-described absorption roller.

Also, the fifth invention that accomplishes the above-described objectives is an image forming apparatus, and is characterized in that the apparatus includes a photosensitive belt that is a photoconductor for forming a latent image, a developing roller for developing the latent image on the above-described photosensitive belt by means of ink consisting of toner particles dispersed in a predetermined solvent, an absorption roller for absorbing the solvent in the ink developed on the above-described photosensitive belt, a drying roller having a heater inside thereof for evaporating the solvent by means of heat, which has been absorbed by the above-described absorption roller, an air pump for sucking the solvent vaporized by the above-described drying roller, and discharging the solvent in vicinity of the above-described drying roller, and a liquefaction device for cooling, liquefying and collecting the vaporized solvent in a conduit between the above-described air pump and the above-described absorption roller.

Also, the sixth invention that accomplishes the above-described objectives is an image forming apparatus, and is characterized in that the apparatus includes a photosensitive belt that is a photoconductor for forming a latent image, a developing roller for developing the latent image on the above-described photosensitive belt by means of ink consisting of toner particles dispersed in a predetermined solvent, an absorption roller for absorbing the solvent in the ink developed on the above-described photosensitive belt, a drying roller having a heater inside thereof for evaporating the solvent by means of heat, which has been absorbed by the above-described absorption roller, a liquefaction device for cooling, liquefying and collecting the vaporized solvent, a duct for leading the solvent vaporized by the above-described drying roller to the above-described liquefaction device, and an air pump for sucking the solvent vaporized by the above-described drying roller and leading it to the above-described liquefaction device, and discharging it on a side of the above-described drying roller of the above-described duct.

Also, the seventh invention that accomplishes the above-described objectives is an image forming apparatus having an electro-photographic image forming system, and is characterized in that a latent image electrically formed on a photoconductor is developed using ink in which toner particles are dispersed in a solvent and a toner image is created, and after the above-described toner image is transferred on a transfer member such as paper, the above-described transferred image is fixed by means of heating, pressurization and so forth, and a copied material is obtained, and the apparatus includes absorption means for absorbing the solvent from the toner image developed on the above-described photoconductor, drying means for drying and vaporizing the solvent absorbed by the above-described absorption means, liquefaction and collection means for cooling, and liquefying and collecting the solvent dried and vaporized by the above-described drying means, and circulation means for circulating the solvent rarefied without being liquefied and collected by the above-described liquefaction and collection means from the above-described liquefaction and collection means to vicinity of the above-described drying means through the circulation means, and wherein the gaseous solvent circulated to the above-described drying means by the above-described circulation means is mixed with a solvent newly collected by the above-described absorption means and dried and vaporized by the above-described drying means, and the above-described mixed gas is liquefied and collected again by the above-described liquefaction and collection means.

Also, the eighth invention that accomplishes the above-described objectives is characterized in that, in the above-described seventh invention, the solvent dried and vaporized by the above-described drying means is sucked into the above-described liquefaction and collection means by the above-described circulation means through a conduit connecting a duct for housing the above-described absorption means and the above-described drying means to the above-described liquefaction and collection means.

Also, the ninth invention that accomplishes the above-described objectives is characterized in that, in the above-described eighth invention, the gaseous solvent sucked into the above-described liquefaction and collection means is liquefied and collected by the above-described liquefaction and collection means, and however, the gaseous solvent rarefied without being liquefied and collected is sucked into the above-described circulation means through a conduit connecting the above-described liquefaction and collection means to the above-described circulation means.

Also, the tenth invention that accomplishes the above-described objectives is characterized in that, in the above-described ninth invention, the rarefied gaseous solvent sucked into the above-described circulation means is discharged in vicinity of the above-described drying means within the above-described duct through a conduit connecting the above-described duct to the above-described circulation means.

Also, the eleventh invention that accomplishes the above-described objectives is a photoconductor cleaning method for an image forming apparatus having an electro-photographic image forming system, and is characterized in that a latent image electrically formed on a photoconductor is developed using ink in which toner particles are dispersed in a solvent and a toner image is created, and after the above-described toner image is transferred on a transfer member such as paper, the above-described transferred image is fixed by means of heating, pressurization and so forth, and a copied material is obtained, and the method includes an absorption step of, by absorption means, absorbing the solvent from the toner image developed on the above-described photoconductor, a drying step of, by drying means, drying and vaporizing the solvent absorbed at the above-described absorption step, a liquefaction and collection step of cooling the solvent dried and vaporized at the above-described drying step, and liquefying and collecting it by liquefaction and collection means, a circulation step of circulating the solvent rarefied without being liquefied and collected at the above-described liquefaction and collection step from the above-described liquefaction and collection means to vicinity of the above-described drying means through circulation means, and a step of mixing the gaseous solvent circulated to the above-described drying means at the above-described circulation step with a solvent newly collected at the above-described absorption step and dried and vaporized at the above-described drying step, and liquefying and collecting the above-described mixed gas again by the above-described liquefaction and collection means.

Also, the twelfth invention that accomplishes the above-described objectives is characterized in that, in the above-described eleventh invention, the solvent dried and vaporized at the above-described drying step is sucked into the above-described liquefaction and collection means by the above-described circulation step through a conduit connecting a duct for housing the above-described absorption means and the above-described drying means to the above-described liquefaction and collection means.

Also, the thirteenth invention that accomplishes the above-described objectives is characterized in that, in the above-described twelfth invention, the gaseous solvent sucked into the above-described liquefaction and collection means is liquefied and collected at the above-described liquefaction and collection step, and however, the gaseous solvent rarefied without being liquefied and collected is sucked into the above-described circulation means by the above-described circulation step through a conduit connecting the above-described liquefaction and collection means to the above-described circulation means.

Also, the fourteenth invention that accomplishes the above-described objectives is characterized in that, in the above-described thirteenth invention, the rarefied gaseous solvent sucked into the above-described circulation means is discharged in vicinity of the above-described drying means within the above-described duct by the above-described circulation step through a conduit connecting the above-described duct to the above-described circulation means.

Also, the fifteenth invention that accomplishes the above-described objectives is an image forming apparatus, and is characterized in that the apparatus includes an absorption roller for absorbing a solvent from a toner image developed on a photosensitive belt, a drying roller for drying and vaporizing the absorbed solvent, a liquefaction device for cooling, liquefying and collecting the dried and vaporized solvent, and an air pump for circulating a gas that has not been liquefied by the liquefaction device from the liquefaction device to vicinity of the drying roller, and wherein the gas is mixed with a newly dried and vaporized solvent, and the mixed gas is liquefied and collected again by the liquefaction device.

BRIEF DESCRIPTION OF THE DRAWINGS

This and other objects, features and advantages of the present invention will become more apparent upon a reading of the following detailed description and drawing, in which.

DESCRIPTION OF THE EMBODIMENTS

Figure 1:
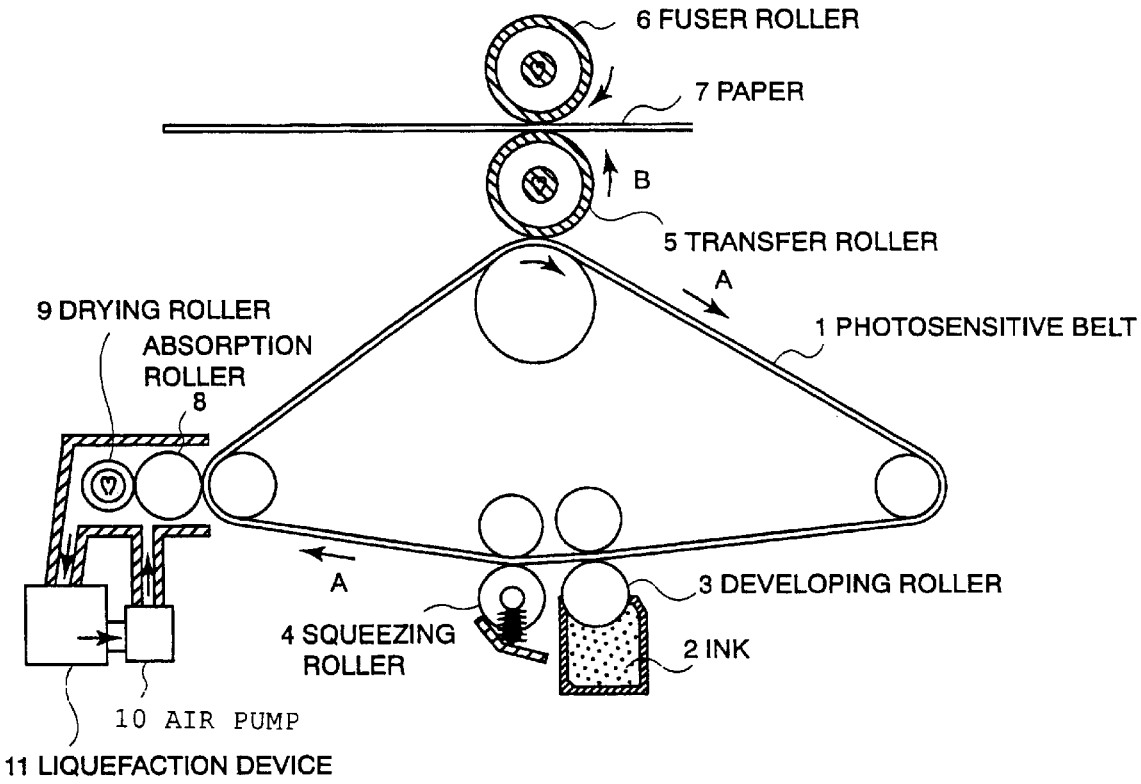
FIG. 1 is a view showing a schematic arrangement of an image forming apparatus in one embodiment of the present invention.

Below, an embodiment of the present invention will be explained in detail referring to the drawing.

FIG. 1 is a view showing a schematic arrangement of an image forming apparatus in one embodiment of the present invention.

As shown in FIG. 1, an image forming apparatus in this embodiment has a photosensitive belt 1 that is a photoconductor for forming a latent image, a developing roller 3 for developing the latent image on the photosensitive belt 1 by means of ink 2 consisting of toner particles dispersed in a solvent, a squeezing roller 4, which is in contact with the above-described photosensitive belt 1, for squeezing the solvent by applying pressure to the ink 2 forming the developed image, a transfer roller 5 being in contact with the above-described photosensitive belt 1 and having a heater inside thereof, and a fuser roller 6 being in contact with the transfer roller 5 and having a heater inside thereof, and the apparatus is constructed so that, by means of a transport rollers (not shown), paper 7 is transported to an NIP section between the above-described transfer roller 5 and the fuser roller 6.

The ink 2 forming the developed image on the above-described photosensitive belt 1 is solidified by removing the solvent by means of heat or pressure and so forth, and has a characteristic that it is transferred to a material which has large affinity for the ink 2, and by making affinity of the above-described photosensitive belt 1, transfer roller 5 and paper 7 become larger in that order, finally the ink 2 is adapted to be transferred to the paper 7.

Also, the image processing apparatus in this embodiment has, within the same duct, an absorption roller 8 for removing the solvent of the ink 2, which is in contact with a predetermined position of the photosensitive belt 1 in the middle of a path from the transfer roller 5 to the squeezing roller 4, along which the photosensitive belt 1 is driven, and a drying roller 9 that is provided so as to be in contact with the absorption roller 8 for maintaining absorption capability of the absorption roller 8. In addition, the drying roller 9 has a heater inside thereof for fulfilling its drying function.

Further, in the image processing apparatus in this embodiment, for controlling an air flow for the solvent vaporized by the drying roller 9, an air pump 10 is placed through the above-described duct having the absorption roller 8 and the drying roller 9 inside thereof, and a conduit, and also, for liquefying and collecting the solvent vaporized by the drying roller 9, a liquefaction device 11 is placed through the above-described duct and other conduit. Also, these air pump 10 and liquefaction device 11 are placed so as to be connected to each other through a conduit.

Based on the above-described arrangement, the solvent vaporized by the drying roller 9 is sucked by the air pump 10, and thereby, it flows from the duct to the liquefaction device 11 through the conduit, and it is cooled, liquefied and collected in the liquefaction device 11. The solvent that has not been liquefied here is discharged in vicinity of the drying roller 9 within the duct from a discharge opening of the air pump 10 through the conduit.

Next, the operation of the image processing apparatus in the above-described embodiment of the present invention will be explained.

The photosensitive belt 1 that is a photoconductor rotates in a direction along an arrow A in FIG. 1, and after its photosensitive surface is uniformly charged by an electrostatic charging device (not shown), by means of a radiated ray such as a laser (not shown), a predetermined latent image is formed on the photosensitive surface. Next, same as a case of a known electro-photographic system, by means of the developing roller 3, the ink 2 consisting of toner particles dispersed in the solvent adheres to a part of the photosensitive belt 1, on which the latent image has been formed, and development is made.

The ink 2 for forming the developed image on the above-described photosensitive belt 1 is, as mentioned above, solidified by removing the solvent by means of heat or pressure and so forth, and has a characteristic that it is transferred to a material having large affinity. Accordingly, by applying pressure to the ink 2 by means of the squeezing roller 4 in contact with the photosensitive belt 1, and removing the solvent in the ink 2 to some extent, the ink 2 forming the developed image is solidified to some extent, and further, by absorbing the solvent by means of the absorption roller 8, full solidification is made.

And, by making affinity of the transfer roller 5 for the ink 2 larger than affinity of the photosensitive belt 1 for the ink 2, the ink 2 is transferred on the transfer roller 5. Also, the transfer roller 5 rotates in a direction along an arrow B, and the fuser roller 6 in contact with the transfer roller 5 relatively rotates with respect to the transfer roller 5. Also, the fuser roller 6 has a heater inside thereof, and the paper 7 is transported to an NIP section between the fuser roller 6 and the transfer roller 5.

At this time, by setting the affinity of the transfer roller 5 for the ink 2 smaller than affinity of the paper 7 for the ink 2, the solidified ink 2 is transferred on the paper 7. Also, by means of the transfer roller 5, heat and pressure provided to the ink 2 by the fuser roller 6, the solvent within the ink 2 is completely removed, and toner is fixed to the paper 7.

In order to maintain absorption capability of the absorption roller 8, by means of the drying roller 9 that is in contact with the absorption roller 8 and has a heater inside thereof, the absorbed solvent is vaporized. The vaporized solvent is sucked by the air pump 10, and passes a conduit from the drying roller 9 to the liquefaction device 11, and is liquefied in the liquefaction device 11. Here, the liquefaction 11 is known one, and conducts liquefaction by cooling the vaporized solvent, and however, since there are some problems in aspects of size, weight and a cost for liquefying the solvent in a gas to the extent of nearly 100%, devices adopting water cooling, air cooling and so forth are utilized.

At this time, much steam exists in the gas, and however, since generally liquefaction temperature of the solvent is higher than liquefaction temperature of water, much steam is contained in the gas after it passed the liquefaction device 11.

As shown in FIG. 1, in the embodiment of the present invention, an arrangement is adopted, in which the solvent vaporized by the drying roller 9 is sucked by the air pump 10 so as to flow in a direction from the drying roller 9 to the liquefaction device 11 through a conduit therebetween, and a gas consisting of the solvent that has not been liquefied by the liquefaction device 11, and steam is sucked by the air pump 10, and is discharged in vicinity of the drying roller 9 through a conduit from a discharge opening of the air pump 10 to the drying roller 9, and an air flow is circulated.

As explained above, the solvent absorbed by the absorption roller 8 is rarefied by liquefaction and collection by means of the liquefaction device 11 after the solvent is dried and vaporized by the drying roller 9, and a gas vaporized here is mixed with a solvent newly dried and vaporized by the absorption roller 8, and thereby, an air flow is circulated.

As apparent from the above explanation, according to the present invention, it is possible to provide an apparatus at a low cost, in which, after a solvent absorbed by an absorption body of revolution is dried and vaporized, the solvent is rarefied by liquefying and collecting it by means of liquefaction means, and the solvent that has not been liquefied and collected here is mixed with a solvent newly collected, dried and vaporized by means of the absorption body of revolution, and it is circulated so that it is liquefied and collected by the liquefaction device again, and thereby, the vaporized solvent is not discharged outside the apparatus, and environment protection is taken into account.

Also, it is possible to provide an apparatus having high user maintenanceability, in which consumption goods such as a filter for discharging the collected solvent are not required.

The entire disclosure of Japanese Patent Application No. 11-231954 filed on Aug. 18, 1999 including specification, claims, drawing and summary are incorporated herein by reference in its entirety.

What is claimed is:

1. An image forming apparatus comprising:

a photosensitive belt that is a photoconductor for forming a latent image;

a developing roller for developing said latent image on said photosensitive belt by means of ink consisting of toner particles dispersed in a predetermined solvent;

an absorption body of revolution for absorbing said solvent in said ink developed on said photosensitive belt;

a drying roller having a heater inside thereof for evaporating said solvent by means of heat, which has been absorbed by said absorption body of revolution;

an air pump for sucking said solvent vaporized by said drying roller;

a liquefaction device for cooling, liquefying and collecting said vaporized solvent in a conduit between said air pump and said absorption body of revolution; and a transfer roller being in contact with said photosensitive belt and having a heater inside thereof, and a fuser roller being in contact with said transfer roller and having a heater inside thereof, both of which are disposed downstream from said absorption body of revolution, and wherein paper is transported between said transfer roller and said fuser roller by transport rollers for transporting said paper, and said ink is transferred on said paper, and vapor from said air pump is discharged in a conduit between said drying roller and said liquefaction device.

2. An image forming apparatus comprising:

a photosensitive belt that is a photoconductor for forming a latent image;

a developing roller for developing said latent image on said photosensitive belt by means of ink consisting of toner particles dispersed in a predetermined solvent;

an absorption roller for absorbing said solvent in said ink developed on said photosensitive belt;

a drying roller having a heater inside thereof for evaporating said solvent by means of heat, which has been adsorbed by said absorption roller;

an air pump for sucking said solvent vaporized by said drying roller, and discharging said solvent in a conduit between said drying roller and said liquefaction device; and a liquefaction device for cooling, liquefying and collecting said vaporized solvent in a conduit between said air pump and said absorption roller.

3. An image forming apparatus comprising:

a photosensitive belt that is a photoconductor for forming a latent image;

a developing roller for developing said latent image on said photosensitive belt by means of ink consisting of toner particles dispersed in a predetermined solvent;

an absorption roller for absorbing said solvent in said ink developed on said photosensitive belt;

a drying roller having a heater inside thereof for evaporating said solvent by means of heat, which has been absorbed by said absorption roller;

a liquefaction device for cooling, liquefying and collecting said vaporized solvent;

a duct for leading said solvent vaporized by said drying roller to said liquefaction device; and an air pump for sucking said solvent vaporized by said drying roller and leading it to said liquefaction device, and discharging it to a conduit between said drying roller and said liquefaction device.

4. An image forming apparatus having an electrophotographic image forming system, wherein a latent image electrically formed on a photoconductor is developed using ink in which toner particles are dispersed in a solvent and a toner image is created, and after said toner image is transferred on a transfer member such as paper, said transferred image is fixed by means of heating, pressurization and so forth, and a copied material is obtained, said apparatus comprising:

absorption means for absorbing said solvent from said toner image developed on said photoconductor;

drying means for drying and vaporizing said solvent absorbed by said absorption means;

liquefaction and collection means for cooling, and liquefying and collecting said solvent dried and vaporized by said drying means; and circulation means for circulating said solvent rarefied without being liquefied and collected by said liquefaction and collection means from said liquefaction and collection means to a location intermediate the drying means and liquefying means, and wherein said gaseous solvent circulated to said drying means by said circulation means is mixed with a solvent newly collected by said absorption means and dried and vaporized by said drying means, and said mixed gas is liquefied and collected again by said liquefaction and collection means.

5. An image forming apparatus according to claim 4, wherein said solvent dried and vaporized by said drying means is sucked into said liquefaction and collection means by said circulation means through a conduit connecting a duct for housing said absorption means and said drying means to said liquefaction and collection means.

6. An image forming apparatus according to claim 5, wherein said gaseous solvent sucked into said liquefaction and collection means is liquefied and collected by said liquefaction and collection means, and however, said gaseous solvent rarefied without being liquefied and collected is sucked into said circulation means through a conduit connecting said liquefaction and collection means to said circulation means.

7. An image forming apparatus according to claim 6, wherein said rarefied gaseous solvent sucked into said circulation means is discharged through a conduit connecting said duct to said circulation means.

8. A photoconductor cleaning method for an image forming apparatus having an electro-photographic image forming system, wherein a latent image electrically formed on a photoconductor is developed using ink in which toner particles are dispersed in a solvent and a toner image is created, and after said toner image is transferred on a transfer member such as paper, said transferred image is fixed by means of heating, pressurization and so forth, and a copied material is obtained, said method comprising:

an absorption step of, by absorption means, absorbing said solvent from said toner image developed on said photoconductor;

a drying step of, by drying means, drying and vaporizing said solvent absorbed at said absorption step;

a liquefaction and collection step of cooling said solvent dried and vaporized at said drying step, and liquefying and collecting it by liquefaction and collection means;

a circulation step of circulating said solvent rarefied without being liquefied and collected at said liquefaction and collection step from said liquefaction and collection means to a location intermediate said drying means and said liquefaction and collection means; and a step of mixing said gaseous solvent circulated to said drying means at said circulation step with a solvent newly collected at said absorption step and dried and vaporized at said drying step, and liquefying and collecting said mixed gas again by said liquefaction and collection means.

9. A photoconductor cleaning method for an image forming apparatus according to claim 8, wherein said solvent dried and vaporized at said drying step is sucked into said liquefaction and collection means by said circulation step through a conduit connecting a duct for housing said absorption means and said drying means to said liquefaction and collection means.

10. A photoconductor cleaning method for an image forming apparatus according to claim 9, wherein said gaseous solvent-sucked into said liquefaction and collection means is liquefied and collected at said liquefaction and collection step, and however, said gaseous solvent rarefied without being liquefied and collected is sucked into said circulation means by said circulation step through a conduit connecting said liquefaction and collection means to said circulation means.

11. A photoconductor cleaning method for an image forming apparatus according to claim 10, wherein said rarefied gaseous solvent sucked into said circulation means is discharged within said duct by said circulation step through a conduit connecting said duct to said circulation means.

12. An image forming apparatus comprising:

an absorption roller for absorbing a solvent from a toner image developed on a photosensitive belt;

a drying roller for drying and vaporizing said absorbed solvent;

a liquefaction device for cooling, liquefying and collecting said dried and vaporized solvent; and an air pump for circulating a gas that has not been liquefied by said liquefaction device from said liquefaction device to a location intermediate said drying roller and said liquefaction device, and wherein said gas is mixed with a newly dried and vaporized solvent, and said mixed gas is liquefied and collected again by said liquefaction device.

* * * * *